United States Patent [19]

Redman

[11] 4,031,393

[45] June 21, 1977

[54] THERMAL IMAGE CAMERA

[75] Inventor: Charles M. Redman, Las Cruces, N. Mex.

[73] Assignee: The United States of America as represented by the Secretary of the Army, Washington, D.C.

[22] Filed: Mar. 18, 1976

[21] Appl. No.: 667,936

[52] U.S. Cl. ..... 250/332; 250/316; 250/333

[51] Int. Cl.² ..... H01J 31/49

[58] Field of Search ..... 250/316, 330, 332, 333, 250/334

[56] References Cited

UNITED STATES PATENTS

| | | | |
|---|---|---|---|
| 1,936,514 | 11/1933 | Lengnick | 250/332 |
| 2,120,765 | 6/1938 | Orvin | 250/332 |
| 2,816,954 | 12/1957 | Huffman | 250/333 X |
| 3,502,875 | 3/1970 | Ploss et al. | 250/332 |

*Primary Examiner*—Archie R. Borchelt
*Attorney, Agent, or Firm*—Nathan Edelberg; Robert P. Gibson; Saul Elbaum

[57] ABSTRACT

The camera includes an input focussing and image cycling system to alternately cycle between a thermal reference and a thermal image, onto a thermally sensitive layer. Means are provided for electronically controlled conversion of thermal images to electron images. Further means, defined in the camera, accomplish electronic image integration and storage. The output portion of the camera includes means to furnish image intensification, after integration and storage. Photographic or electrostatic film is pulled at a constant rate by a drive system positioned at the output of the camera, to expose film to the intensified image.

10 Claims, 2 Drawing Figures

THERMAL IMAGE CAMERA

RIGHTS OF THE GOVERNMENT

The invention described herein may be manufactured, used, and licensed by or for the United States Government for governmental purposes without the payment to me of any royalty thereon.

FIELD OF THE INVENTION

The present invention relates to an electronically controlled camera for converting thermal images to electron images, for impingement on a film. Specifically, this invention relates to the recording of images in the radiation wavelengths of optical to over 100 microns. Its value is primarily for radiation longer than 1 micron since there are presently excellent cameras for shorter wavelengths.

BRIEF DESCRIPTION OF THE PRIOR ART

State-of-the-art thermal image cameras typically use a raster scan detection system. One or a few detector-amplifier channels are caused to scan the angular space of inerest and view only a very small part of the angular space at any moment of time. Detector dwell time on any one point in space is very short as it must scan so many points. A single channel scanning system and 18 ms frame time allows only 1.8 nanoseconds per point for a $10^7$ resolution system to detect and amplify the signal. Even a 1000 channel system allows only 1.8 microseconds per point. The present invention, with $10^7$ channels can dwell 15 milliseconds per point per 18 milliseconds frame time considering a loss of 17 percent due to electronic and thermal cycling.

BRIEF DESCRIPTION OF THE PRESENT INVENTION

The development of melt-grown oxide-metal composites by the Georgia Institute of Technology is opening up a new field of three-dimensional electronic processing. That is, electronic signals varying in area or $x$–$y$ as well as time can be integrated, stores, amplified, and gated. The invention takes advantage of this flexibility.

Thermal images and references are focussed onto and cycled on a thermally sensitive area to convert differential thermal energy to electrons. These electrons are freed from the thermally sensitive area through electron field emission from millions of submicron metal points which are grid controlled. Grid control of these metal points allows electronic control of the magnitude and direction of the charge across pyroelectric thermal detectors. The electrons developed through thermal cycling are integrated and stored in millions of small capacitors. Electrons from one or many thermal cycles can be stored in these capacitors. Electronic grid control gates the stored electron images forward into millions of electron multiplier tubes where they are amplified in numbers and kinetic energy. Amplified images land on electrostatic film or paper and can be converted to visible images by processing through a toner or the images can be accelerated to high kinetic energy which can expose photographic film for photographic processing and developing.

BRIEF DESCRIPTION OF THE DRAWINGS

The above-mentioned objects and advantages of the present invention will be more clearly understood when considered in conjunction with the accompanying drawings, in which.

DETAILED DESCRIPTION OF THE PRESENT INVENTION

The thermal image camera (TIC) is a device or system to accept images in the wavelengths of optical to over 100 microns (to be further referred to as thermal), develop corresponding electron images through detection at millions of points in a plane, integrate and store the electrons in millions of very small capacitors, gate the electron images forward on command into corresponding electron multiplier tubes which are typically at reduced air pressure but not necessarily a complete vacuum, and impact the multiplied electrons into electron sensitive photographic film or electrostatic recording paper. The TIC is a three-dimensional electronic data processing system to convert thermal images to electron images and further to record images on photographic film or electrostatic paper. The referenced three-dimensional data processing system refers to the customary $x$ and $y$ coordinates of a flat image together with the third dimension of time exposure.

Figure 1:
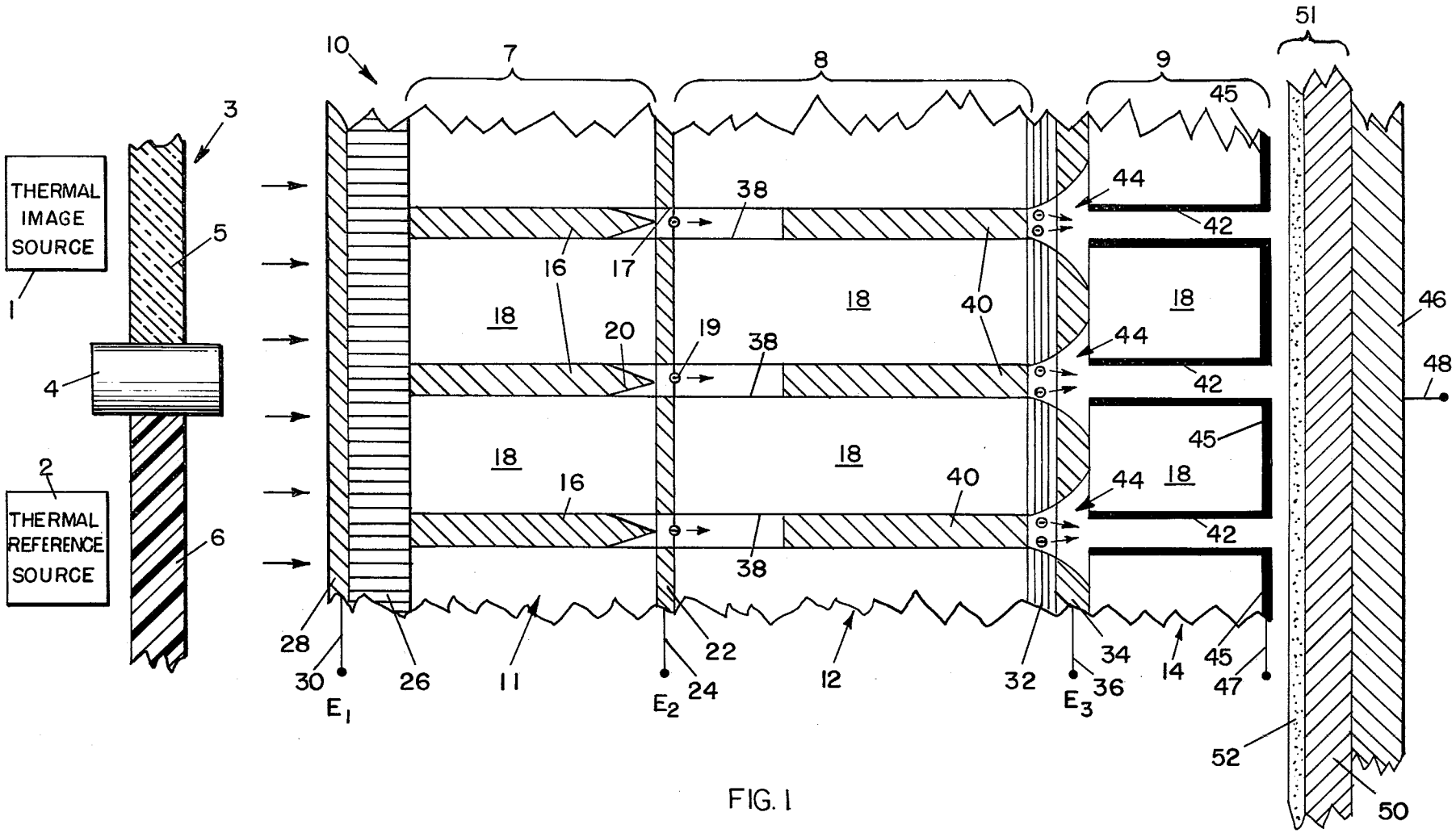
FIG. 1 is a partial sectional view of a first embodiment of the present invention.

The TIC is related to a thermal image projector/recorder (TIPR) which has been documented in technical journals. Techniques of construction are similar and the input stage is similar, however, the modes of recording on film or paper differ. The TIPR uses an output deformographic film and Schlieren optical to transfer images onto photographic film, whereas, the TIC transfers the images electronically and multiplies the density and energy of the image in the process. FIG. 1 is a drawing of a section of the electronic portion of the TIC and includes a section of the recording film or paper.

Referring to FIG. 1, the image converting portion of the TIC is generally indicated by reference numeral 10. To the left of the image converter is a chopper for alternately cycling between a thermal image source 1, which is the image with which we are concerned, and a thermal reference source 2 which provides a fixed thermal energy input to the TIC. A chopper disk 3, of conventional design, is mounted on a rotating shaft 4. Segments of the disk include windows 5 and opaque portions 6. As the disk 3 rotates, energy from the thermal image source 1 and the thermal reference source 2 will alternately pass through the windows 5 of the disk 3. The thermal image source may be an infra-red image detector while the thermal reference source 2 may be a suitable infra-red generator having constant energy emission. The image converting portion 10 of the TIC is constructed as follows. A sample of melt-grown metal-oxide composite as developed on an Advanced Research Projects Agency contract with the Georgia Institute of Technology is the starting material. These composites consist of millions of high-temperature metal fibers such as tungsten fibers in a matrix of a ceramic such as uranium oxide. These metal fibers are quite consistently spaced, parallel, and extend through the ceramic. The sample is first ground or worked to a small cylinder or other desired cross section with parallel ends. Indexing lines are then marked from end to end. The sample is then sliced or cut into three shorter cylinders or substrates and the ends polished and cleaned. These three sections are operated on separately and form substrates 7, 8 and 9 for the respective stages 11, 12 and 14 in FIG. 1. The first substrate 7, shown in FIG. 1, has a layer of pyroelectric film 26 deposited on the left or input side of the substrate material 18. The material for the pyroelectric film may be Triglycine Sulphate. However, this material is merely exemplary. A metal grid 22 is deposited on the left or input end of substrate 8 and a lead 24 is connected thereto, to apply a control potential $E_2$. An electrically conducting film 28 is deposited on the left side or input end of the pyroelectric film. A lead 30 is connected to the conducting film 28 to apply control potential $E_1$ thereto. The electrically conducting film 28 is essentially transparent to the thermal radiation from the image source 1 and reference source 2. Thermal radiation enters the pyroelectric film 26 and causes it to heat according to the intensity of the radiation, at any moment in time. Pyroelectric materials electronically respond to changes in temperature but not to fixed temperatures, which is why a cycling action of the chopper disk 3 must be used. Furthermore, the pyroelectric film 26, serving as a detector, exhibits a capacitive effect and electrons removed from it must be returned or the film will charge to a cutoff level. This requires electronic cycling as well as thermal cycling. The electronic cycling will be described hereinafter. The metal fibers of the previously mentioned composite form electron field emitting cathodes. The junction between the left end of each cathode 16 and the pyroelectric film 26 forms a thermal detector. Thus, due to the millions of cathodes 16, there are millions of thermal detectors present in the image converting portion 10, of the TIC. Each detector is in series with a respective electron field emitting cathode 16. Each cathode 16 is formed with a pointed outward end 20 that is free to emit electrons 19 through a hole 17 formed in the grid 22. The grid 22 has holes formed in respective registry with the pointed ends of the cathodes 16 for better electron delivery through the image converting device 10. Thus far, the structure of the image converter 10 has been explained with reference to the first stage of the converter, between the conducting film 28 and the grid 22. The second stage 12 of the converter 10 includes a second substrate 8 positioned in abutting relationship with the first mentioned substrate 7. The second stage 12, like the first stage 11 has a ceramic material of the aforementioned composite imbedded with fibers, such as the cathodes 16. However, by properly etching the left ends of the fibers 40, a passageway or tube 38 develops, in registry with the holes 17 of grid 22. During fabrication of the image converter 10, the tubes 38 should be formed in the environment of a vacuum so that they in essence form vacuum tubes. The resulting fibers 40, in the second stage 12 are in communicating relationship with respective cathodes 16. The grid 22 is designed to minimize both distance and capacitance between the grid and each cathode 16, as it is desired that each thermally freed electron, such as 19 be emitted into its vacuum tube 38. With the fibers 40 considered as emitting elements, the grid 22 is designed to maximize both the distance and capacitance between the grid and each emitting element 40, so as to maximize the number of image electrons which can be stored at each emitter element 40. At the output of stage 11, each cathode is free to emit electrons through a corresponding hole in the grid 22 which is in communication with a corresponding vacuum tube 38. At the output end of stage 12 are two juxtaposed grid layers. The first of these grids 32 is fabricated from an insulator material. Outwardly of this grid is a second grid 34 fabricated from a metal. Construction of all the grids 22, 32 and 34 may typically be done by depositing an insulator or dielectric such as aluminum oxide on the output or right faces of substrates 7 and 8. Aluminum is deposited on the input and output faces of the substrate 8. Use of differential potentials and differential etches are used to remove aluminum first, and then oxide from over each metal fiber end 16, 40 in the vicinity of a respective grid thus creating a metal film isolated electrically from the fibers and with a grid hole in registry with each fiber end. This allows electrons emitted from each fiber to pass through its own grid hole.

A fluted or bell-shaped opening 44 is fashioned in the grids 32, 34, in registry with a corresponding emitting element 40. Each of the opening 44 communicates with a corresponding passageway 42 in substrate 9, which itself is in registry with the end of the emitting element 40. The passageways 42 are the result of having the metal fibers, that were originally present therein, in the previously mentioned composite material, etched out entirely. A high resistive secondary emission material 45 lines the passageways 42 but the left and right end of the substrate 9 must allow current flow through the emission material which lines the passageways so as to keep blocking potentials for large differential voltages from building up in the passageways. Each electron entering a passageway 42 must cause electron multiplication in its passageway for image amplification.

The three substrates 7, 8 and 9 or at least the substrates 7 and 8, must be assembled and securely fastened together in a high vacuum. The indexing lines are used to ensure that assembly will line up fibers and/or the tubes and passageways in almost the same configuration as they were before the original composite material was cut.

A lead 36 is connected to the grid 34 to apply a potential $E_2$ thereto. A lead 47 is connected to the secondary emission material 45, in substrate 9, to apply a potential thereto.

Electronic operation of the TIC is cycled with thermal image and thermal reference cycling. With a thermal reference on the film 28, and grids 22 and 34 made sufficiently positive, electrons will flow as follows: from secondary emission material lining 45, by electron field emission to grid 34 and the emitting elements 40 in stage 12, by electron field emission from the emitting elements 40 to grid 22 and the cathode 16. Current will flow in millions of channels, each channel defined between the input or left end of cathode 16, tube 38, emitting element 40, opening 44, and finally passageway 42. This current flow will continue until electron field emission cutoffs are reached at grids 22 and 34, leaving corresponding charges across the pyroelectric detector capacitances to film 28. Potentials are then reversed and electrons flow through the channels in the opposite direction until electron field emission cutoffs are reached again at grids 22 and 34. Grid 34 is then made less positive to bring it well below that required for electron field emission, but still positive with respect to grid 22. In order to complete the electrical hook up, a conducting backplate 46 supports a recording medium 51 including photographic film 50, having an emulsion 52 in confronting relationship with the right end of substrate 9. A lead 48 is connected to the the backplate to apply a potential thereto. Backplate potential at lead 48, is raised to a level to suitably expose the recording medium 51. The pyroelectric film 26 is then exposed to the thermal sources 1 and 2, alternately. Image hot spots or spots at a higher temperature than the reference cause electrons to be released to cathodes 16, in substrate 7. Since the voltage between grid 22 and adjacently positioned ends of cathodes 16 is at the point of electron field emission, the electrons are emitted into the corresponding small vacuum tubes 38 and into the corresponding emitting elements 40. They remain in the elements 40 since grid 34 is below the level to allow electron field emission. A very short positive pulse distributed between grid 34, secondary emission material lining 45, and backplate 46 causes the image electrons to move forwardly toward the recording medium 51. As the electrons move through the passageways 42, they multiply and impact on the recording medium 51 with sufficient energy to record. In the case of electrostatic paper or film, the electrons have to reach the recording medium but do not need high energy. The aforementioned operation would continue to cycle for each image detected and recorded.

The above operation allows only one image frame input for each recorded frame. Thermally sensitive materials typically have relatively low heat flow resistance, therefore, thermal images soon smear out or disappear. This problem is solved through a subcycle operation. That is, for each potential cycle at 36, 47 and 48, there may be a large numer of $E_1$, $E_2$ electronic and input thermal cycles. For instance, the subcycle may be at a 6 KHz rate and the full cycle of 60 Hz rate and 100 images integrated before one is moved forward onto the film or paper. This essentially allows a long exposure time and a short thermal smear time.

Figure 2:
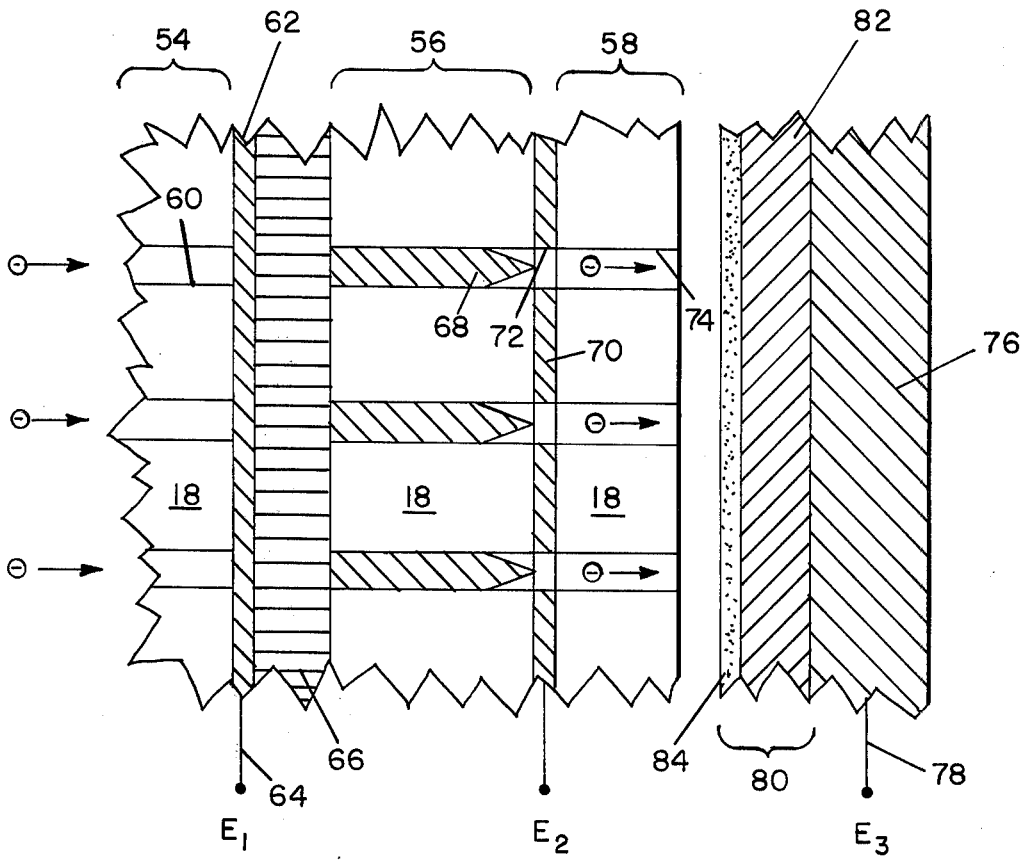
FIG. 2 is a partial sectional view of a second embodiment of the present invention.

FIG. 2 illustrates the second embodiment of the invention. For simplicity, the chopper section and pyroelectric detecting section have been left off. Thus, the tube sections 60 would accommodate the output or pointed ends of cathodes, such as 16, of FIG. 1. However, the embodiment shown in FIG. 2 does not include a grid such as 22 (FIG. 1). Rather, the right end or output end of the tubes 60, which are formed in a first substrate 54, terminate in a conductive film 62. A lead 64 is connected to the conductive film so that it may act as a control electrode. Juxtaposed to the right surface of the conductive film 62 is a semiconductor layer 66. The purpose of this semiconductor layer is to achieve additional gain. Further, this embodiment illustrates that the gain stage can be moved back in the middle of the TIC, rather than in the output portion, as was the case in connection with FIGURE 1.

Structurally, a second substrate 56 is positioned to the right of the first substrate 54. Cathodes 68, similar to the previously mentioned cathodes 16 (FIG. 1) are embedded in the substrate 56. A third substrate 58 is positioned adjacent the second substrate 56, with a deposited grid 70 intervening therebetween. The grid has openings 72, in registry with respective cathodes 68. The substrate 58 has passageways 74 respectively communicating with the holes 72 in the grid 70. The outward ends of the passageways confront a recording medium 80, identical to that previously mentioned in connection with recording medium 51. The impacting surface of the recording medium is indicated at 84 and is a dielectric layer, in the case of electrostatic paper or an emulsion layer in the case of photographic film. The backing material 82 of the recording medium 80 is paper in the case of electrostatic recording and is plastic film in the case of photographic recording. A metallic backplate 76 is provided with a lead 78 upon which a potential $E_3$ is applied. A slide surface is defined between the backplate 76 and the recording medium. In operation of the device, the recording medium executes motion over the slide surface.

The TIC is a 150 line pair/mm recording system as based on melt-grown metal-oxide composites with $10^7$ metal fibers per square centimeter. State-of-the-art for these composites is presently about 1 cm diameter which gives an overall resolution of 1500 line pairs. Thirty-five mm composites should be available with some development work to allow 5250 line pair resolution.

Contrast is primarily a function of film recording contrast and electron storage levels. It is anticipated that photographic film should furnish superior resolution to electrostatic paper. Assuming an electron image storage element can have a capacitance of $7 \times 10^{18}$F and an electron field emission spacing of 1 micron, it can store 175 image electrons before electron field emission occurs. High dielectric constant materials might replace the aluminum oxide and increase storage by a factor of 10 for a dynamic range of 1750 levels.

The TIC is, therefore, expected to approach optical quality pictures out past 10 micron wavelengths.

Sensitivity of the TIC is a relative factor. In general, pyroelectric materials are less sensitive than some other materials but this disadvantage decreases as the wavelength increases. The big advantages of pyroelectrics is they do not require cooling and their response is relatively flat with wavelength. The big sensitivity factor for the TIC is dwell time. Based on an 18 millisecond frame time and $10^7$ picture elements a single channel thermal scanning system has only 1.8 nanoseconds to resolve a picture element. The TIC would have about 15 milliseconds per element or a dwell time 8.3 $\times 10^6$ longer than the scanner. The TIC can, therefore, use a less sensitive detection material and still be far more sensitive than the scanner.

It should be understood that the invention is not limited to the exact details of construction shown and described herein for obvious modifications will occur to persons skilled in the art.

I claim the following:

1. A thermal image camera comprising:

pyroelectric means for detecting a thermal image;

cathode means connected to the pyroelectric means for converting the thermal image to an electron image;

vacuum means communicating with the cathode means for guiding the passage of the electron image in a preselected location;

emitting means communicating with the vacuum means, in spaced relation with the cathode means, for storing and integrating the electron image;

means communicating with the emitting means for amplifying the density and kinetic energy of the electron image delivered from the emitting means; and recording means positioned adjacent the outward end of the amplifying means for receiving an amplified electron image thereagainst.

2. The subject matter of claim 1 together with means cooperating with the cathode means for controlling an electric field established across that cathode means thus controlling electron field emission into and out of the cathode means.

3. The subject matter of claim 2 together with means located between the emitting means and the recording means for gating the electron image, toward the recording means over a very short time compared to the storage-integration time.

4. The subject matter of claim 3 wherein the cathode means are comprised of a plurality of small metal fibers.

5. The subject matter as set forth in claim 3 wherein the emitting means are comprised of a plurality of small metal fibers.

6. The subject matter as set forth in claim 3 wherein the cathode means and the emitting means are comprised of a plurality of small metal fibers.

7. The subject matter as set forth in claim 6 wherein the vacuum means are a plurality of tubes formed in registry with respective cathode means and emitting means.

8. The subject matter as set forth in claim 7 together with light chopping means positioned in optical alignment with the pyroelectric means for alternately exposing the pyroelectric means to a thermal image source and a thermal reference source thus producing a differential thermal image on the pyroelectric means.

9. A thermal image camera comprising:

pyroelectric means for detecting a thermal image;

cathode means connected to the pyroelectric means for converting the thermal image to an electron image;

vacuum means communicating with the cathode means for guiding the passage of the electron image along a preselected direction;

semiconductor means interposed at an outward end of the vacuum means for amplifying the density and kinetic energy of the electron image;

emitting means connected at a first end thereof to the semiconductor means for storing and integrating the amplified electron image;

means positioned adjacent an opposite end of the emitting means for controlling the time of storage and integration; and recording means positioned outwardly from the controlling means for receiving an amplified electron image thereagainst.

10. The subject matter of claim 9 wherein the emitting means are comprised of a plurality of small metal fibers.

* * * * *